US007424264B2

(12) United States Patent
Hayashi et al.

(10) Patent No.: US 7,424,264 B2
(45) Date of Patent: Sep. 9, 2008

(54) IMAGE FORMATION APPARATUS AND IMAGE FORMATION METHOD

(75) Inventors: Akihiro Hayashi, Okazaki (JP); Kenichi Hayashi, Toyokawa (JP); Tomonobu Tamura, Toyokawa (JP); Hiroyuki Yoshikawa, Hoi-gun (JP); Tatsuya Eguchi, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 11/368,615

(22) Filed: Mar. 7, 2006

(65) Prior Publication Data

US 2007/0081840 A1 Apr. 12, 2007

(30) Foreign Application Priority Data

Oct. 6, 2005 (JP) ..... 2005-293995

(51) Int. Cl.
*B41J 29/38* (2006.01)
*G03G 21/00* (2006.01)

(52) U.S. Cl. ..... 399/366; 400/76

(58) Field of Classification Search ..... 399/366, 399/80, 228, 365; 358/408, 468, 462, 401, 358/451, 578, 300, 524; 380/54, 51, 201
See application file for complete search history.

(56) References Cited

U.S. PATENT DOCUMENTS 6,192,127 B1 * 2/2001 Nagashima et al. ..... 380/201
6,782,217 B1 * 8/2004 Ando ..... 399/79
2005/0134622 A1 * 6/2005 Yamaguchi ..... 347/15
2005/0162697 A1 * 7/2005 Kiwada ..... 358/1.18
2006/0023260 A1 * 2/2006 Miki et al. ..... 358/3.28
2006/0126095 A1 * 6/2006 Tamura et al. ..... 358/1.14

(Continued)

FOREIGN PATENT DOCUMENTS

JP 05282448 A * 10/1993

(Continued)

OTHER PUBLICATIONS

Machine translation of Takagi (JP 05282448) from Japanese Patent Office website.*

(Continued)

*Primary Examiner*—Daniel J Colilla
(74) *Attorney, Agent, or Firm*—Buchanan Ingersoll & Rooney PC

(57) ABSTRACT

A multi-functional copying machine according to the invention has a scanner for reading the image of a document and image information appended to the document and a printer for forming the image on a medium. It compares the image read by the scanner and the image information, determines according to the extent of alteration of the image whether or not reproduction of the image of the document as it is can be permitted and, if permitted, produces a copy from the reproduced image of the document. If reproduction is forbidden of the image of the document as it is, whether or not to permit restoration of the scanner-read image according to the image information is determined and, if permitted, a copy is produced from the restored image. This makes it possible to keep track of any alteration in a copyrighted image by quick processing, prevent altered copyrighted images from circulation, and protect copyrighted images appropriately.

20 Claims, 10 Drawing Sheets

U.S. PATENT DOCUMENTS

| | | | | |
|---|---|---|---|---|
| 2006/0126096 | A1* | 6/2006 | Yasukaga et al. | 358/1.14 |
| 2006/0216051 | A1* | 9/2006 | Namba | 399/54 |

FOREIGN PATENT DOCUMENTS

| | | | | |
|---|---|---|---|---|
| JP | 07-307821 | | | 11/1995 |
| JP | 2000-196786 | A | | 7/2000 |
| JP | 2001-257863 | | | 9/2001 |
| JP | 2004276515 | A | * | 10/2004 |
| JP | 2004-334380 | A | | 11/2004 |
| JP | 2005-094275 | | | 4/2005 |
| JP | 2005-193422 | | | 7/2005 |
| JP | 2005204177 | A | * | 7/2005 |
| JP | 2005-205729 | | | 8/2005 |

OTHER PUBLICATIONS

Machine translation of Yamamoto (JP 200504177) from Japanese Patent Office website.*

Notification of Reasons for Refusal issued in corresponding Japanese Patent Application No. 2005-293995, and translation thereof.

* cited by examiner

IMAGE FORMATION APPARATUS AND IMAGE FORMATION METHOD

CROSS-REFERENCE TO RELATED APPLICATIONS

This application is based upon and claims the benefit of priority from the prior Japanese Patent Application No. 2005-293995 filed on Oct. 6, 2005, the entire contents of which are incorporated herein by reference.

BACKGROUND OF THE INVENTION

1. Field of the Invention

The present invention relates to an image formation apparatus and an image formation method for producing a copy of the image of a document on a medium. More particularly, it relates to an image formation apparatus and an image formation method for appropriate processing of any alteration, such as degradation in picture quality, damage or color change (hereinafter referred to as simply "alteration(s)", whether it is intentional or not), occurring on an image covered by protection under a copyright or any other intellectual property right, in the document, where the alteration makes this image different from the original image.

2. Description of the Related Art

Images to be processed by an image formation apparatus include objects of an exclusive right such as a copyright (hereinafter referred to as simply "copyright"). For this reason, various techniques have been proposed by which copyrighted works (works of authorship protected by a copyright) can be protected and their reproduction can be appropriately restricted. For instance, Japanese unexamined patent publication No. 2000-196786 discloses a technique by which information on the prohibition or permission of copying can be added to printed matter by appending a digital watermark, administrative code or the like.

Japanese unexamined patent publication No. 2004-334380 discloses a technique by which the use of a given copyrighted work can be kept track of by referencing an administrative code appended to the copyrighted work. According to the technique described in this document, a semiconductor memory chip is embedded in the copyrighted work, for instance. It is claimed that, by monitoring the administrative code stored in the chip via a network, the copyrighted work can be kept under administration.

However, these known techniques involve the following problems. Since one or another of various networks is referenced for information on copyrighted works by the technique described in either of these documents, this might impose heavy loads on the network, and the processing might accordingly take a long time. Moreover, though reproduction is restricted, no mention is made of processing against any altered part in the copyrighted image to be copied. This means that, if within the limit of permitted reproduction, even an altered image could be circulated as it is.

SUMMARY OF THE INVENTION

The present invention has been attempted to solve the above-noted problems involved in the related art. Thus, an object of the invention is to provide an image formation apparatus and an image formation method which detect any alteration in copyrighted images to be processed in a short period of time, spread of altered copyrighted images to be prevented and thereby copyrighted works to be appropriately protected.

To achieve the above object of the present invention, there is provided an image formation apparatus for producing copies of documents containing images, comprising: an image reading unit for reading the image of a document; an image information acquiring unit for acquiring image information of the document; and a permission/refusal determining unit for comparing the image read by said image reading unit and the image information acquired by said image information acquiring unit, and determining whether or not reproduction of the image of the document as it is can be permitted according to the extent of difference between the read image and the acquired image information, wherein a copy is produced from the reproduced image of the document if permitted by said permission/refusal determining unit.

According to another aspect of the present invention, there is provided an image formation method for producing copies of documents containing images, comprising steps of: reading the image of a document; acquiring image information of the document; assessing the extent of difference between the image read from the document and the acquired image information by comparing them; determining whether or not reproduction of the image of the document as it is can be permitted according to the extent of difference; and producing a copy of the document from the reproduced image of thereof if permitted.

According to the invention, an image of a document picked up by an image reading unit is compared with image information on the document acquired by an image information acquiring unit. Alteration in the image of the document is identified from the result of that comparison. Therefore any alteration in the image of the document can be determined by processing in a short period of time. Furthermore, according to the altered state of the image of the document, a permission/refusal determining unit determines whether or not to permit reproduction of the image of the document as it is. Thus, since its reproduction as it is may not be permitted depending on the state of alteration, unacceptably altered images can be prevented from circulation. This configuration results in an image formation apparatus and an image formation method which can identify any alteration of copyrighted images by processing in a short amount of time, prevent unacceptably altered copyrighted images from circulation and thereby enable copyrighted works to be appropriately protected.

DETAILED DESCRIPTION OF THE PREFERRED EMBODIMENT

A preferred embodiment of the present invention will be described in detail below with reference to the accompanying drawings. A multi-functional copying machine 1 embodying the invention is configured to have the appearance shown in FIG. 1. The multi-functional copying machine 1 has a copying function to print the image of a document onto an output sheet. The multi-functional machine may also have a function to transmit outside image data acquired from a document and/or a function to print an image according to image data received from outside. It is further provided with a function to acquire copyright information regarding the image of a document and perform appropriate processing on that basis.

Figure 1:
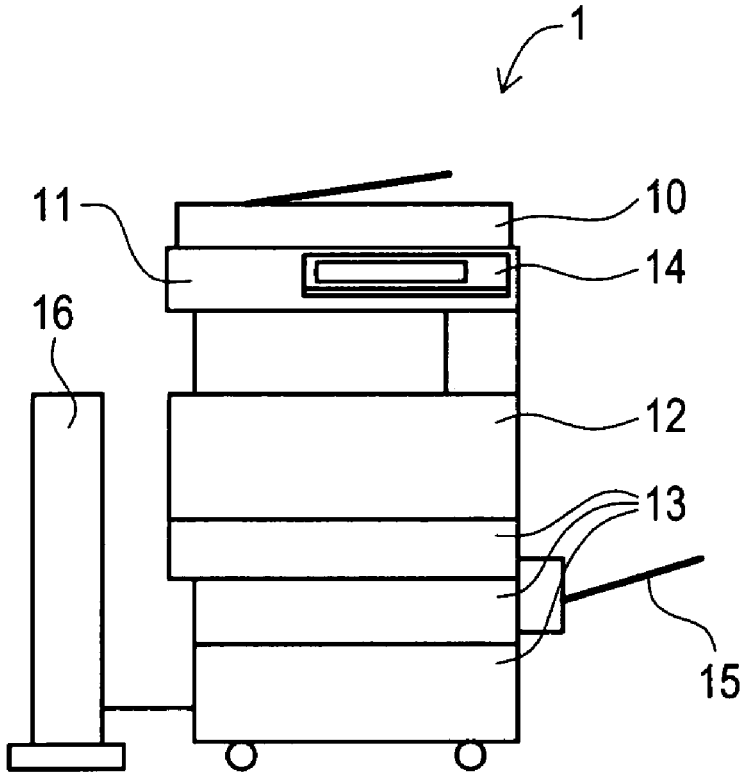
FIG. 1 shows a front view of a multi-functional copying machine embodying the present invention.

As shown in FIG. 1, the multi-functional copying machine 1 has in its top part an automatic document feeding device 10, underneath which the machine has a scanner 11, a printer 12 and a sheet feeding device 13 in a descending order. A control and display panel 14 is arranged on the front face of the scanner 11, and a manual feed tray 15 is disposed on a side of the sheet feeding device 13. The control and display panel 14 not only displays information but also accepts control actions for area selection and other purposes. The top face of the printer 12 also serves as a paper ejection tray. The multi-functional copying machine 1 is also provided with a coin dispenser 16. The coin dispenser 16 may as well be built into the multi-functional copying machine 1.

Figure 2:
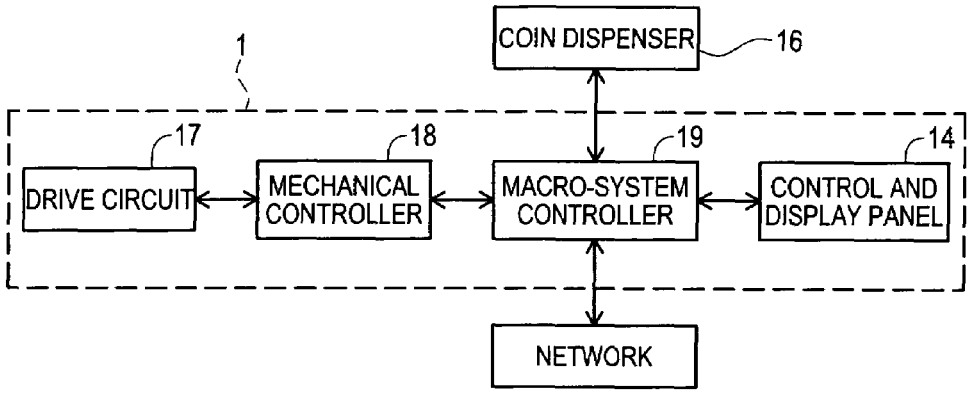
FIG. 2 is a block diagram showing the configuration of the control system of the multi-functional copying machine embodying the invention.

The control system of the multi-functional copying machine 1 is configured as shown in FIG. 2. The multi-functional copying machine 1 shown in FIG. 2 has, in addition to the aforementioned control and display panel 14, a drive circuit 17, a mechanical controller 18 and a macro-system controller 19. The drive circuit 17 is a circuit for driving various mechanical parts in the automatic document feeding device 10, the scanner 11, the printer 12 and the sheet feeding device 13. The mechanical controller 18 is a controller responsible for controlling the drive circuit 17. The macro-system controller 19 is a controller responsible for non-mechanical control in the multi-functional copying machine 1. More specifically, besides handling image data and copyright information, it controls the control and display panel 14, communicates with the coin dispenser 16 and performs transmission to and reception from outside via a network.

Figure 3:
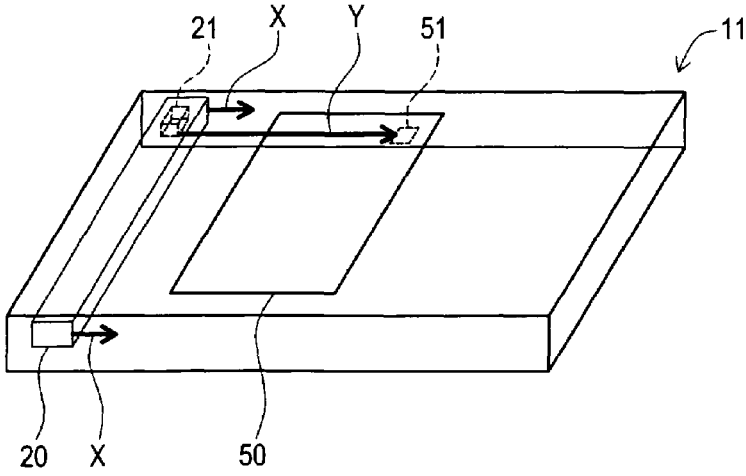
FIG. 3 shows a perspective view of the scanner of the multi-functional copying machine embodying the invention.

The scanner 11 of the multi-functional copying machine 1 is provided with a slider 20 as shown in FIG. 3. The slider 20, when in stationary reading, moves as indicated by arrow X to read the image of a document 50. The slider 20 also has a function to communicate with a memory element 51, such as an IC chip, embedded in the document 50. For this purpose, an antenna 21 is built into the slider 20. The antenna 21 moves as indicated by arrow Y along with the movement of the slider 20 and passes over the memory element 51 of the document 50. If the document 50 has a memory element 51 built in it, required information can be taken out of it. Image data acquired by the slider 20 and data acquired by the antenna 21 from the memory element 51 are entered into the macro-system controller 19 in the control system shown in FIG. 2, and subjected to various modes of processing including image formation. Other elements than the scanner 11, such as the printer 12 and the sheet feeding device 13, have no particular difference from such usual devices.

Figure 4:
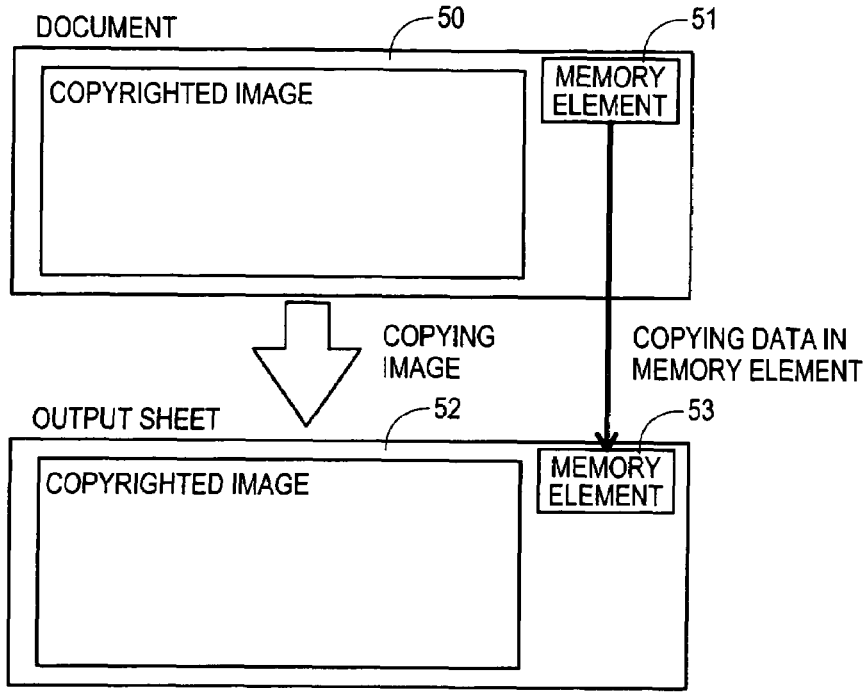
FIG. 4 shows an example of copying of a document in which a copyrighted area is included.

Documents to be copied by the multi-functional copying machine 1 include a document 50 having a copyrighted image part in its image as shown in FIG. 4. The document 50 may be printed on a sheet in part of which a memory element 51 is embedded. In such a document 50, information on the copyrighted image in the document 50 is stored in that memory element 51. This makes it clear that the document 50 is a copyrighted work containing a copyrighted image, and enables its copying to be appropriately restricted. For this purpose, the memory element 51 stores image data on the whole copyrighted image or their compressed or encrypted version. The memory element 51 also stores information on the copyright holder's preference as part of copyright information. This information concerns whether or not, if any alteration is found in the copyrighted image of the document 50, the copyright holder will permit its restoration. This embodiment of the invention is mainly intended for documents 50 having such memory elements 51.

Output sheets 52 are set in the sheet feeding device 13 of the multi-functional copying machine 1. These output sheets 52 are intended for use in producing a copy of the document 50 having a copyrighted image like the one shown in FIG. 4. A memory element 53 is embedded in part of the output sheet 52 as in the document 50. When copying of a document 50 having a copyrighted image is instructed, the sheet feeding device 13 feeds the output sheet 52 to the printer 12.

Next, an example of processing by the multi-functional copying machine 1 will be described. In this example, a document 50 in which image copyright information is attached in a specific area, is to be copied as shown in FIG. 4. The user places this document 50 on a document table, and presses a copying start button. Then the multi-functional copying machine 1 reads out with the scanner 11 the image of the document 50 and the contents of the memory element 51. Then, the copyrighted image stored in the memory element 51 and the image read out by the document 50 are compared with each other. If they are found substantially identical, it will be judged that the copyrighted image is not altered. In this case, the image of the document 50 is printed on the output sheet 52. Further, data stored in the memory element 51 of the document 50 are copied into the memory element 53 which is embedded in part of the output sheet 52.

The criterion according to which it is judged here whether or not the copyrighted image read out of the memory element 51 and the image obtained by reading the document 50 are substantially identical can be set to a level at which any difference can be perceived by naked-eye observation with a view to preventing the distribution of altered copyrighted images. Therefore, even if the copyrighted image data read out of the memory element 51 and the image data obtained by reading the document 50 differ from each other in data form, image resolution or any such technical respect, if the two sets of data are found identical by naked-eye perception, it will be judged that the copyrighted image is not altered. Further, the level setting may be defined according to the contents of image, copyright holder's preference, and others.

Figure 5:
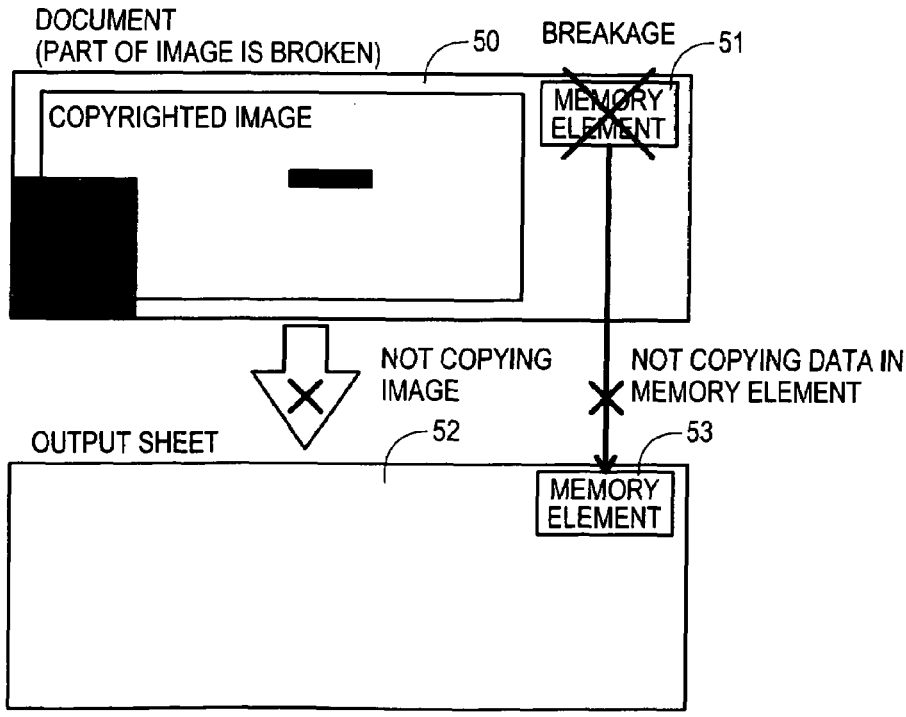
FIG. 5 shows an example of copying of a document in which the copyrighted area is altered.

Next, a case in which the copyrighted image of the document 50 or image data stored in the memory element 51 are found altered as shown in FIG. 5. First, in the event that the memory element 51 is broken and the data therein cannot be read out, this document 50 will not be copied. The processing will end with a display of information, on the control and display panel 14, that the document is unsuitable for copying. When both the image of the document 50 and the image data stored in the memory element 51 are successfully read out, they are compared to assess how much one differs from the other. If the difference is extremely great, it will be difficult to determine which is responsible for the difference, and in the worst case the document may be a completely different one having replaced the authentic image. For this reason, no copying is permissible. In this case too, the processing will end with a display of information, on the control and display panel 14, that the document is unsuitable for copying.

Figure 6:
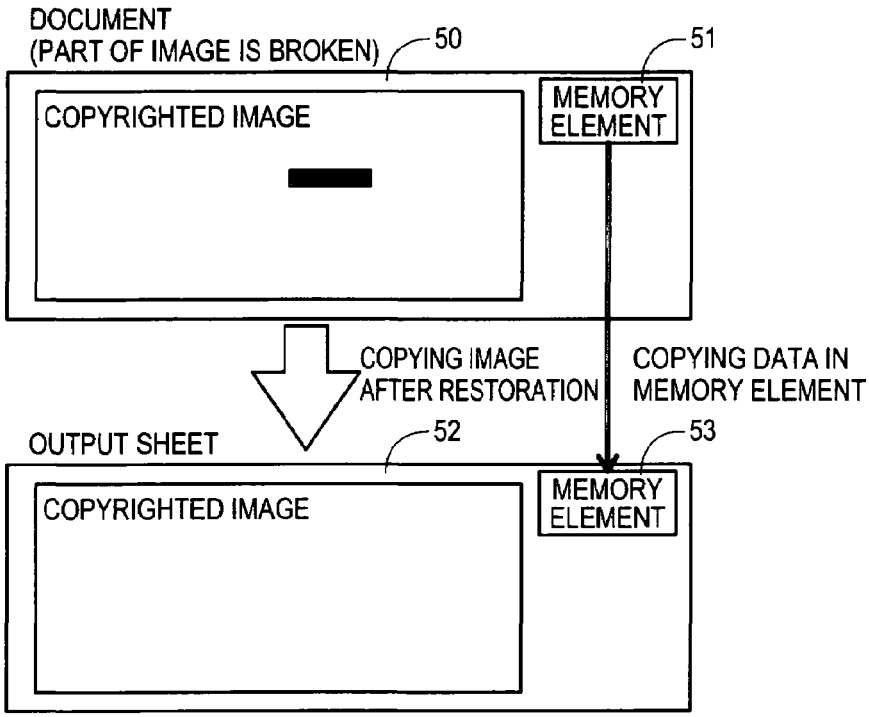
FIG. 6 shows another example of copying of a document in which the copyrighted area is altered.

If the alteration is a partial flaw, the difference will be small. Or if it is an overall color fading, there will be little difference in contour. In such a case, the image of the document 50 can be restored by using the image data stored in the memory element 51 as shown in FIG. 6. As the restoration may involve an extra cost in addition to the regular copying fee, the user's willingness to pay it should be confirmed before executing the copying. Or if the copyright holder's instruction not to permit restoration is stored in the memory element 51, no restoration will be done. If the alteration is beyond a prescribed limit and no restoration is done, the multi-functional copying machine 1 will not print the copyrighted image part.

Figure 7:
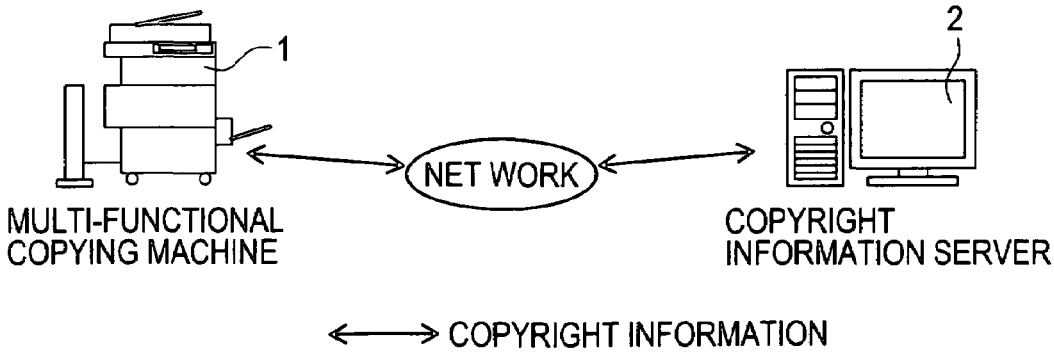
FIG. 7 is a block diagram showing an image formation system embodying the invention.

Incidentally, this multi-functional copying machine 1 can be integrated into a system as shown in FIG. 7. For instance, mutual communication can be accomplished with a copyright information server 2 via a network. This copyright information server 2 is a server in which copyright information on various images is accumulated. In this case, all the pertinent image data need not be stored in the memory element 51 of the document 50. For instance, only identification codes can be stored therein, and image data can be received from the copyright information server 2. Or in a system having a copyright information server 2, paper sheets having no memory element can be chosen as output sheets. In this case, an identification code, either plain or encrypted, can be printed in a margin of each output sheet, and corresponding copyright information can be read from the copyright information server 2 when it will be used for further copying.

Next, an example of output processing of a copyrighted image by the multi-functional copying machine 1 will be described with reference to flow charts of FIG. 8 and FIG. 9. This processing starts with the setting of a document 50 having a memory element 51 in the scanner 11 and the inputting by the user of a starting instruction.

Figure 8:
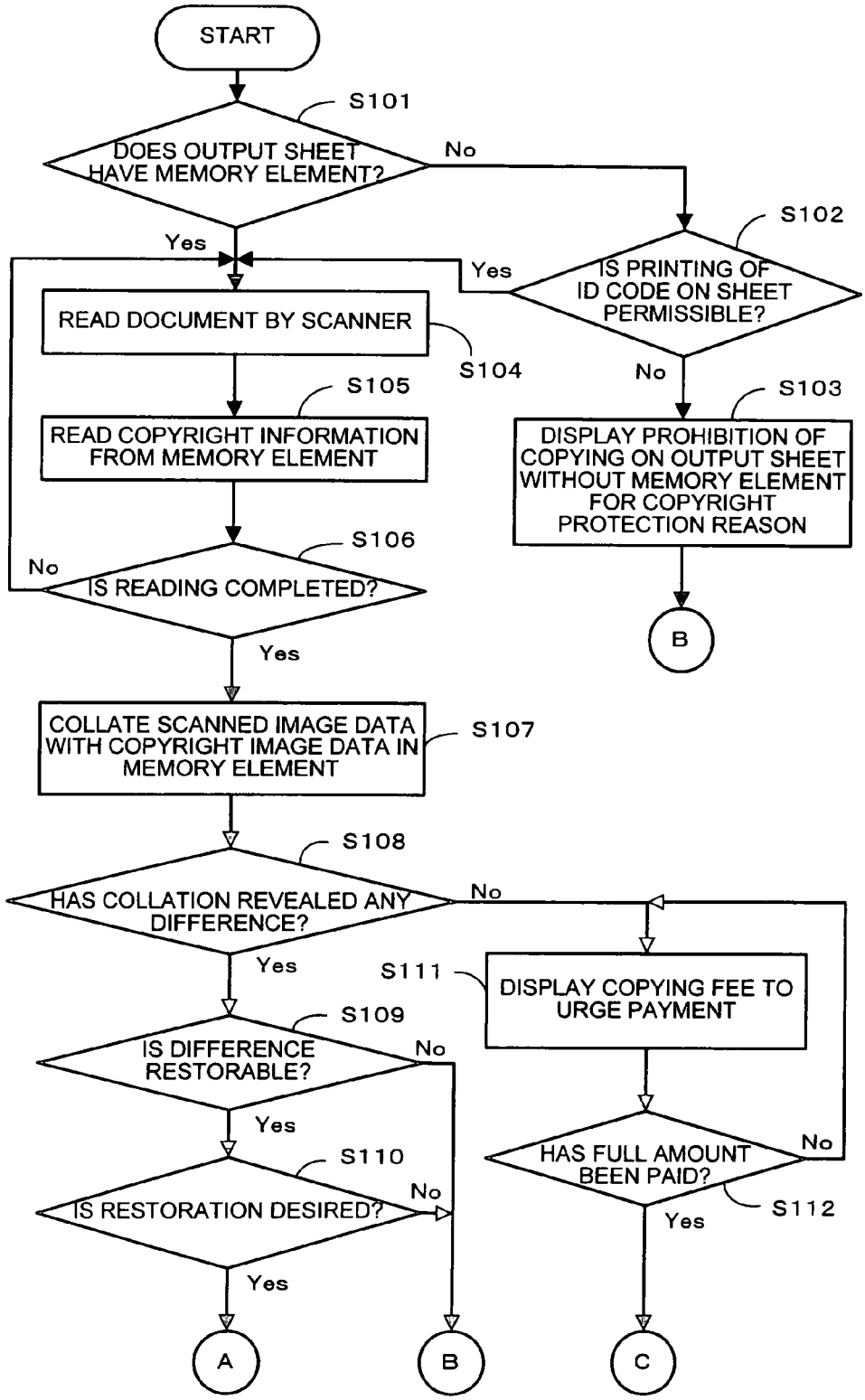
FIG. 8 is a flow chart showing an example of output processing.
Figure 9:
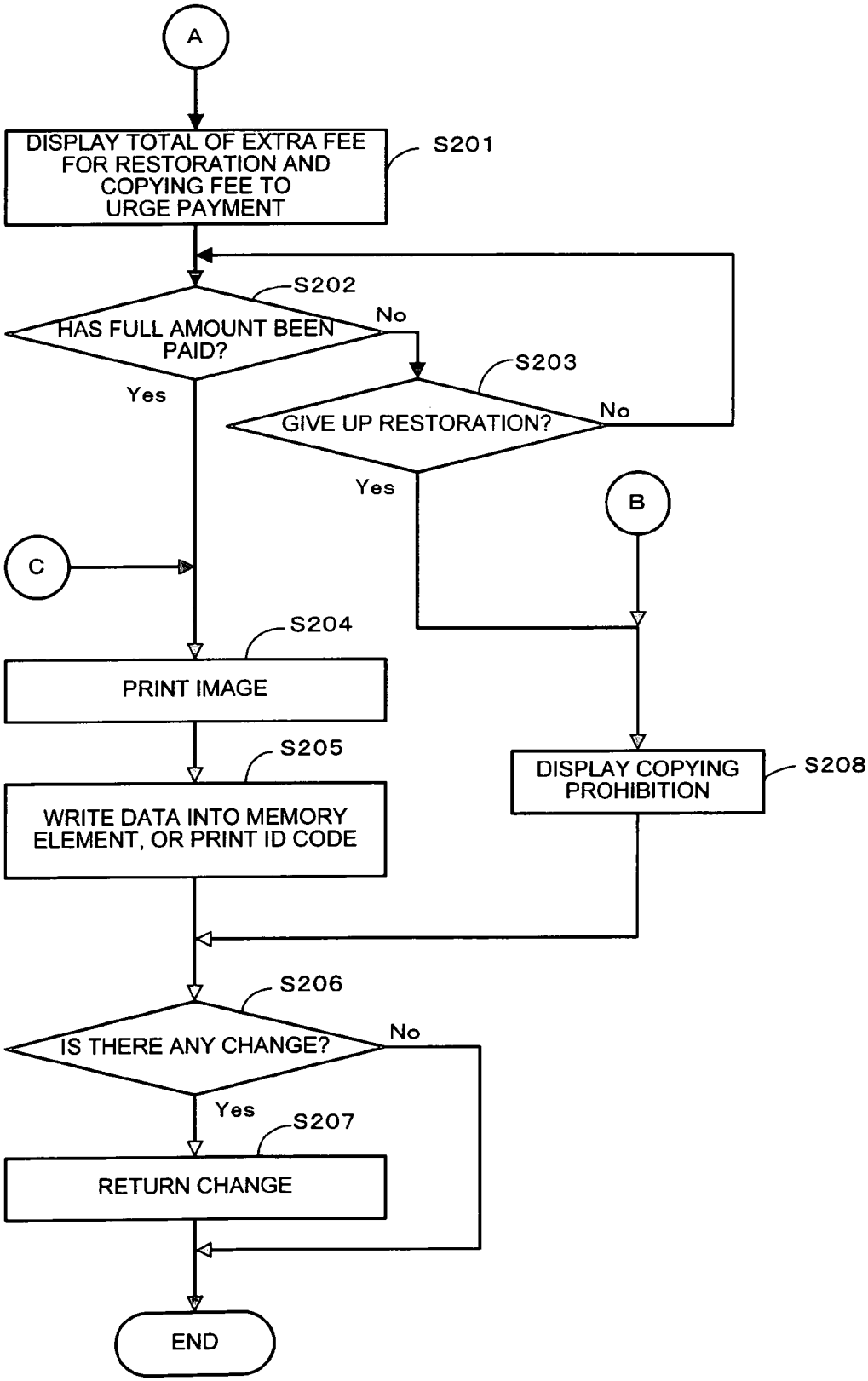
FIG. 9 is a following flow chart showing the example of output processing.

When this processing starts, first it is judged whether or not an output sheet 52 having a memory element 53 is set in the sheet feeding device 13 of the multi-functional copying machine 1 as shown in FIG. 8 (S101). If no output sheet 52 having a memory element 53 is set (S101: No), it is checked with the user whether or not an identification code or the like may be printed in a margin of the output sheet (S102). If the user does not permit printing of an identification code (S102: No), no copying can be done, and accordingly a display to that effect will be given (S103). In this case, the processing will advance to (B) in FIG. 9.

Thus, no image information can be written onto an output sheet having no memory element. Duplication of an image on such an output sheet would result in the loss of image information. For this reason, image formation on such an output sheet is forbidden as a rule with a view to securing distribution of image information.

If an output sheet 52 having a memory element 53 is set (S101: Yes) or printing of an identification code on the output sheet is permitted (S102: Yes), then the image of the document 50 will be read with the scanner 11 (S104). Further, communication with the memory element 51 is also performed via the antenna 21 to read the copyright information stored in the memory element 51 (S105). This sequence between S104 and S105 may be reversed, or the two steps can be processed simultaneously. It is then judged whether or not the image and copyright information in the document have been wholly acquired (S106). If not (S106: No), reading will be continued until all is acquired.

Upon completion of the reading (S106: Yes), the image read by the scanner 11 and the copyrighted image data stored in the memory element 51 are compared and collated with each other (S107). If the result of collation shows the two sets of information to be substantially identical (S108: No), normal copying can be performed. Incidentally, this judgment does not seek perfect identity. Processing for normal copying will be described afterwards.

On the other hand, if the presence of any substantially different parts is found (S108: Yes), the image is not allowed to be copied as it is. Then, it is judged whether or not the altered image can be restored (S109). Thus, it is judged whether or not the copyright holder is willing to permit restoration and whether or not the extent of alteration physically permits restoration. For instance, if the overall difference is too great, it will be difficult to determine which image is altered, and no restoration will be attempted. Or if the two sets of image information are substantially identical but part of the image is missing, or the overall color is found faded, the altered image will be considered restorable.

If the alteration is judged to be too great to permit restoration (S109: No), this document will not be copied. In this case, the processing will advance to (B) in FIG. 9. Or if restoration is judged to be possible (S109: Yes), the willingness of the user who intends to copy the image will be checked (S110). Since restoration of a copyrighted image costs a prescribed additional fee, restoration is executed only at the user's request. Therefore, a question asking the user whether or not he or she desires restoration of the image is displayed on the control and display panel 14 of the multi-functional copying machine 1, and the user's instruction is awaited. If the user desires restoration (S110: Yes), the processing will advance to (A) in FIG. 9. If the user does not desire restoration (S110: No), this document will not be copied, and therefore the processing will advance to (B) in FIG. 9.

Returning a little along the sequence, if the result of collation indicates substantial identity (S108: No), a regular copying fee will be collected (S111). Then, the copying fee is displayed on the control and display panel 14 of the multi-functional copying machine 1, and depositing of the prescribed sum into the coin dispenser 16 is awaited. Or the depositing of the fee into the coin dispenser 16 may be accepted at an earlier step. The deposited sum and the required fee are compared to check whether or not the full amount has been deposited (S112). If it has not been (S112: No), further depositing will be urged (S111). Upon depositing of the full amount (S112: Yes), the processing will advance to (C) in FIG. 9.

Next, FIG. 9 will be explained. If the alteration is restorable and the user desires restoration (S110 in FIG. 8: Yes), the subsequent processing will start with (A) in FIG. 9. Thus, the total of the additional fee for the restoration and the regular copying fee is displayed on the control and display panel 14, and the user is urged to pay (S201). The sum deposited into the coin dispenser 16 is compared with the required fee to check whether or not the full amount has been deposited (S202).

If the full amount has not been deposited (S202: No), the user will be urged to decide whether or not to give up restoration (S203). When the full required amount has been deposited (S202: Yes; or S112 in FIG. 8: Yes), the image will be printed on the output sheet 52 (S204). Further, copyright information is written into the memory element 53 of the output sheet 52 (S205). Or if the response is "Yes" at S102, the identification code will be printed because the output sheet has no memory element 53 (S205). This sequence between S204 and S205 may be reversed, or the two steps can be processed simultaneously. If the deposited sum is greater than required (S206: Yes), the surplus will be returned (S207) to complete this processing.

On the other hand, if restoration is given up (S203: Yes), the output sheet 52 is inadequate (S103 in FIG. 8), the restoration is impossible (S109 in FIG. 8: No), the user does not desire restoration (S110 in FIG. 8: No) or any other reason, the multi-functional copying machine 1 will display on its control and display panel 14 that copying cannot be executed (S208) and end this processing. In this case too, if the fee has already been deposited, the money will be returned.

Thus in this embodiment, even if the image of the document 50 has been altered, if it is judged to be restorable, the image will be restored according to the pertinent image information. Further, a copy will be made of the restored image. This prevents the altered image from multiplication. However, the option of not restoring any image the user does not require is also available. On the other hand, where the image is extremely altered or restoration is forbidden according to the pertinent image information, the image is judged to be impossible to restore. In this case, the image is neither restored nor printed. This prevents wrong restoration or prohibited restoration from being executed. The description of this processing is hereby ended.

Figure 10:
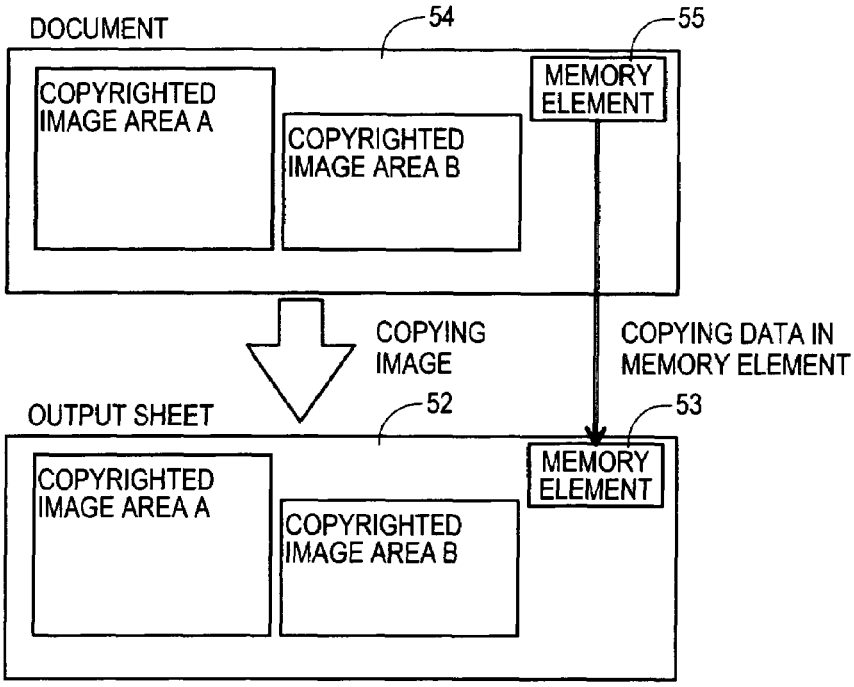
FIG. 10 shows an example of copying of a document in which a plurality of copyrighted areas is included.

Next, processing that takes place when a plurality of copyrighted image areas are included in one document 54 as shown in FIG. 10 will be described. In this case, copyright information on all the areas and their relation are written into a memory element 55. These copyrighted image areas may either constitute a set of mutually related images or be unrelated to one another differing in copyright holder from one to another. The document 54 may further including areas on which no copyright is established and other areas.

Figure 11:
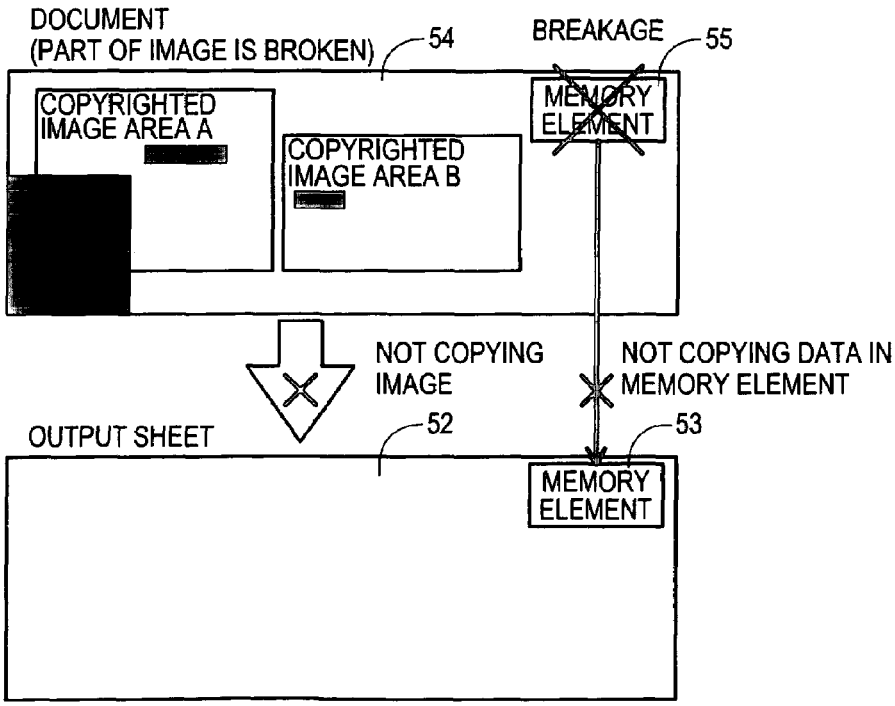
FIG. 11 shows an example of copying of a document in which a plurality of copyrighted areas is partly altered.

When copying of such a document 54 is instructed, the scanned image and the corresponding image data stored in the memory element 55 are compared with respect to each area. Where all the images are unaltered, they can be printed as they are. Or when some of the images are altered as shown in FIG. 11, it is decided whether or not to restore the image with respect to each area. The methods of judgment and processing are the same as for single images. Basically, only printable areas are printed, and copyright information thereon are written into the memory element 53 of the output sheet 52. Therefore, unaltered image areas can be reproduced as they are.

Figure 13:
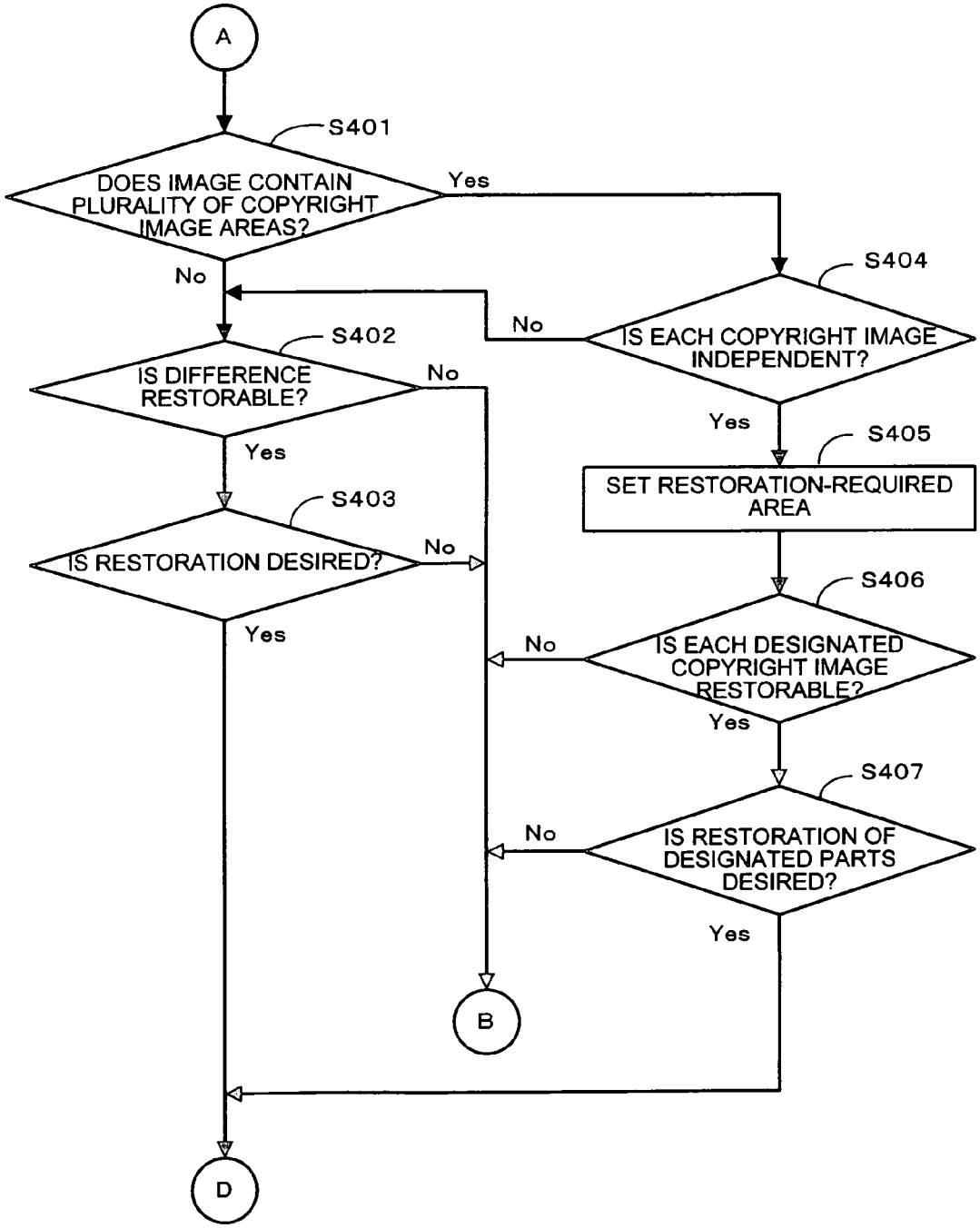
FIG. 13 is a flow chart further showing the second example of output processing.
Figure 14:
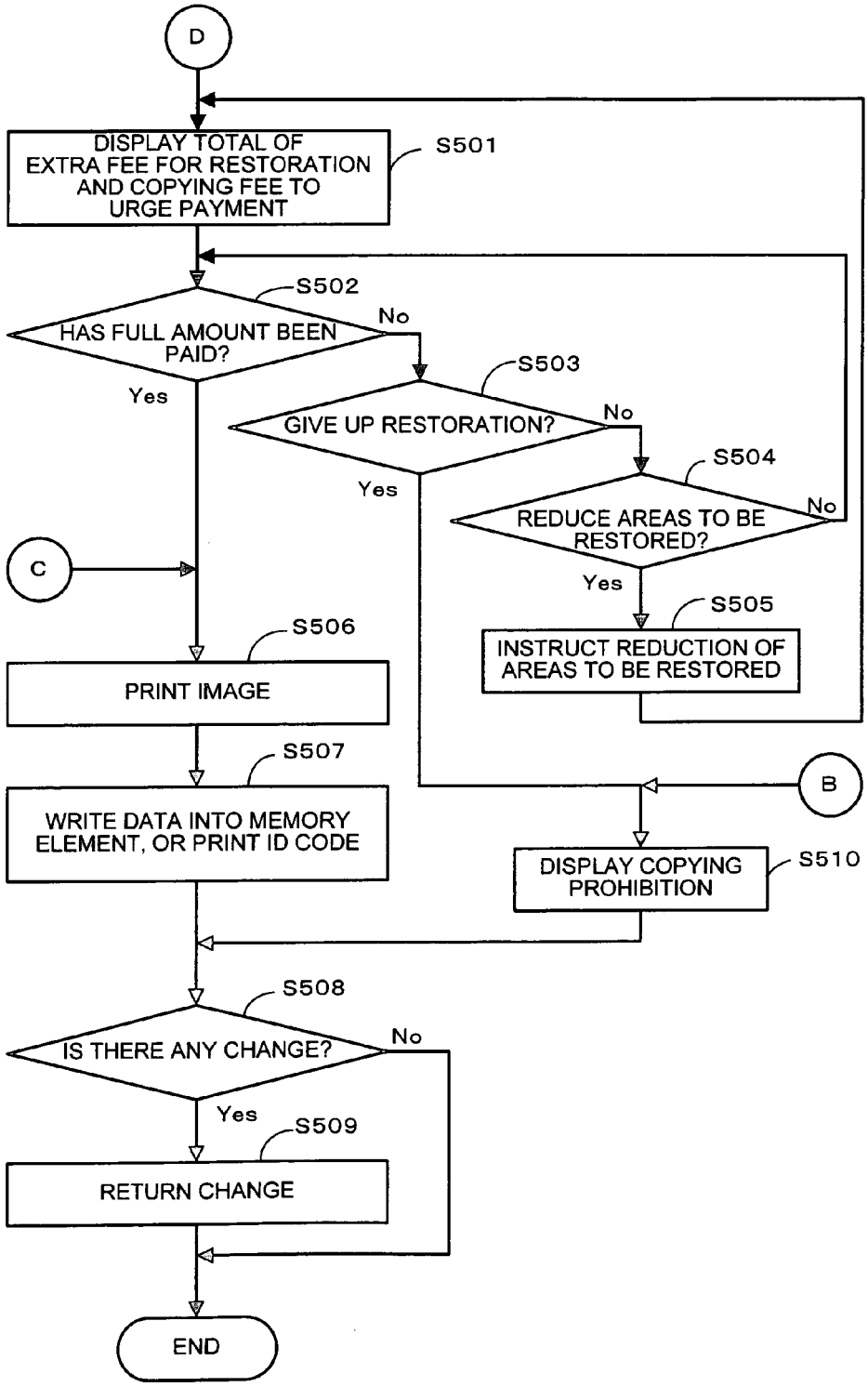
FIG. 14 is a flow chart further showing the second example of output processing.

Next, an example of output processing for a document 54 having a plurality of copyrighted images will be described with reference to flow charts of FIG. 12 through FIG. 14. This processing starts with the setting of the document 54 having a memory element 55 in the scanner 11 and the inputting by the user of a starting instruction.

Figure 12:
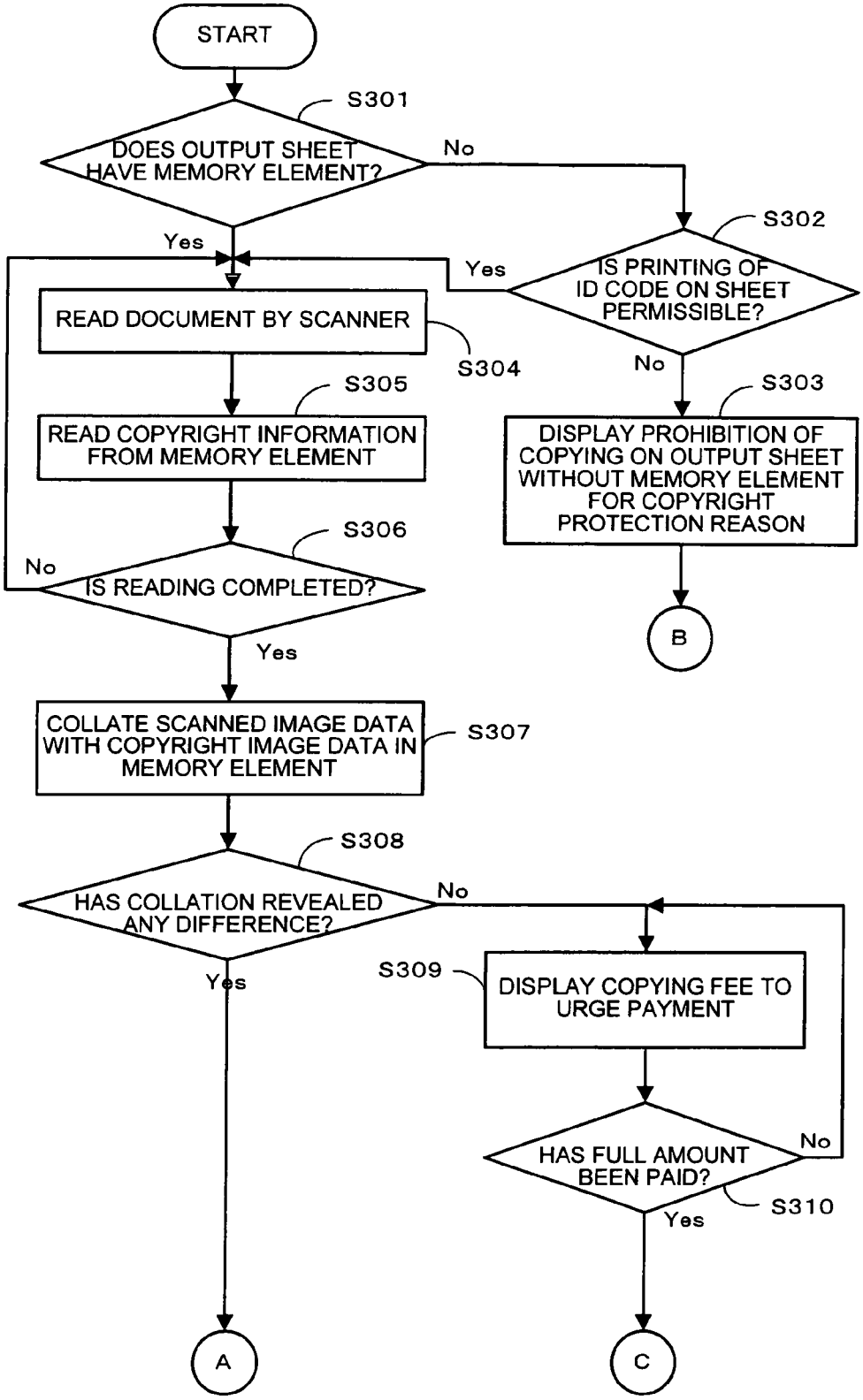
FIG. 12 is a flow chart showing a second example of output processing.

When this processing starts, first it is judged whether or not an output sheet 52 having a memory element 53 is set in the sheet feeding device 13 of the multi-functional copying machine 1 as shown in FIG. 12 (S301). If an output sheet 52 having a memory element 53 is not set (S301: No), it is checked with the user whether or not an identification code or the like may be printed in a margin of the output sheet (S302). If the user does not permit printing of an identification code (S302: No), no copying can be done, and accordingly a display to that effect will be given (S303). In this case, the processing will further advance to (B) in FIG. 14.

If an output sheet 52 having a memory element 53 is set (S301: Yes) or printing of an identification code on the output sheet is permitted (S302: Yes), then the image of the document 54 will be read with the scanner 11 (S304). Further, communication with the memory element 55 is also performed via the antenna 21 to read the copyright information stored in the memory element 55 (S305). This sequence between S304 and S305 may be reversed, or the two steps can be processed simultaneously. It is then judged whether or not the image and copyright information in the document have been wholly acquired (S306). If not (S306: No), reading will be continued until all is acquired.

Upon completion of the reading (S306: Yes), the image read by the scanner 11 and the copyrighted image data stored in the memory element 55 are compared and collated with each other (S307). If the result of collation shows the two sets of information to be substantially identical (S308: No), normal copying can be performed. Then, a regular copying fee will be collected (S309). The copying fee is displayed on the control and display panel 14 of the multi-functional copying machine 1, and depositing of the prescribed sum into the coin dispenser 16 is awaited. Or the depositing of the fee into the coin dispenser 16 may be accepted at an earlier step. The deposited sum and the required fee are compared to check whether or not the full amount has been deposited (S310). If it has not been deposited (S310: No), further depositing will be urged (S309). Upon depositing of the full amount (S310: Yes), the processing will advance to (C) in FIG. 14.

On the other hand, if the presence of any substantially different images are found (S308: Yes), the processing will advance to (A) in FIG. 13. Then, it is first judged whether or not the document 54 includes a plurality of copyrighted image areas (S401). If the document does not include a plurality of areas (S401: No), the processing will be the same as charted in FIG. 8, and it will be judged both whether or not the area is restorable (S402) and whether or not the user desires restoration (S403). Only when the replies to both are "Yes", restoration is carried out. In this case, the processing will advance to (D) in FIG. 14.

Or where a plurality of copyrighted image areas are included (S401: Yes), it is judged whether or not all those copyrighted images are independent of one another (S404). If they are related to one another and established by the copyright holder as set images in the memory element 55 of the document 54 (S404: No), they will be processed in the same way as a single image area (S402 and S403). In this case, judgment as to restorability (S402) is such that the affirmative judgment is given only when all the areas are restorable.

Where all the copyrighted image areas are independent of one another (S404: Yes), areas whose restoration is desired by the user out of the areas judged to have been altered are selected (S405). Unnecessary areas need not be restored. Then, each of the selected areas is judged as to image restorability (S406). Thus, it is judged whether or not the copyright holder permits restoration and whether or not the alteration is slight enough to allow restoration. If the alteration is judged impossible to restore (S406: No), that area will not be copied, and the processing will advance to (B) in FIG. 14.

If the alteration is judged restorable (S406: Yes), the user's willingness will be checked (S407). Since restoration of a copyrighted image costs a prescribed additional fee, restoration is executed only at the user's request. Therefore, a question asking the user whether or not he or she desires restoration of the image is displayed on the control and display panel 14 of the multi-functional copying machine 1, and the user's instruction is awaited. If the user desires restoration (S407: Yes), the processing will advance to (D) in FIG. 14. If the user does not desire restoration (S407: No), this area will not be copied, and the processing will advance to (B) in FIG. 14.

Next, FIG. 14 will be explained. If each of the areas selected by the user is restorable and the user desires restoration (S403: Yes or S407: Yes in FIG. 13), the subsequent processing will start with (D) in FIG. 14. Thus, the total of the additional fee for the restoration and the regular copying fee is displayed on the control and display panel 14, and the user is urged to pay (S501). The sum deposited into the coin dispenser 16 is compared with the required fee to check whether or not the full amount has been deposited (S502).

If the full amount has not been deposited (S502: No), the user will be urged to decide whether or not to give up restoration (S503). The user can reduce the number of areas to be restored (S504) instead of wholly giving up restoration (S503: No). Since the additional fee for restoration is charged on an area-by-area basis, the fee can be reduced by curtailing the number of areas to be restored. If the user desires a reduction in the areas to be restored (S504: Yes), the fee will be calculated anew and displayed (S501) in response to the input of an instruction about the areas to be reduced (S505).

When the full required amount has been deposited (S502: Yes; or S310 in FIG. 12: Yes), the image will be printed on an output sheet 52 (S506). Out of the image areas judged to have been altered, those found impossible or unnecessary to restore will be left blank or some other alternative images will be printed there. Further, copyright information is written into the memory element 53 of the output sheet 52 (S507). Or if the response is "Yes" at S302, the identification code will be printed because the output sheet has no memory element 53 (S507). This sequence between S506 and S507 may be reversed, or the identification code and the image can be printed simultaneously. If the deposited sum is greater than required (S508: Yes), the surplus will be returned (S509) to complete this processing.

On the other hand, if there is no printable image area because restoration is given up (S503: Yes), the output sheet 52 is inadequate (S303 in FIG. 12), the restoration is impossible (S402: No or S406: No in FIG. 13), the user does not desire restoration (S403: No or S407: No in FIG. 13) or any other reason, the multi-functional copying machine 1 will display on its control and display panel 14 that copying cannot be executed (S510) and end this processing. In this case, too, if the fee has already been deposited, the money will be returned. This ends the description of this processing.

As hitherto described in detail, when a document appended with copyright information is to be copied with the multi-functional copying machine 1 embodying the invention in this mode, the image of the document and the appended data are compared and collated with each other to judge whether or not the image is altered. Similar copyright information is also appended to the output sheet. Therefore, copyright information is handed down without having to inquire with any network. Furthermore, any altered image can be restored on the basis of appended data. On the other hand, no altered image is copied as it is. These features make it possible to keep track of any alteration in a copyrighted image by quick processing, prevent altered copyrighted images from circulation, and protect copyrighted images appropriately.

The embodiment was described above merely as an illustrative example, but it is nothing to limit the invention in any way. Therefore, the invention can obviously be improved or modified in various ways without deviating from its essentials. For instance, the intellectual property rights which justify the restriction of reproduction are not limited to copyrights. The restriction of reproduction may be attributed to design rights, trademark rights and other similar rights. The restriction may be set on information itself, which is deemed to be a valuable object. It can as well be used in order to secure the integrity of images with a view to keeping public order and morals.

Although the coin dispenser 16 is used in this embodiment as means of fee collection, bank cards, credit cards, debit cards, prepaid cards and other electromagnetic means of account settlement can as well be used. In that case, the judgment as to whether "Has full amount been paid?" at S111 in FIG. 8 or S202 in FIG. 9 can be made with the credit line of the card or the balance of the card account being used as the maximum. It is also possible to access information on the applicable means of account settlement by using a mobile communication terminal instead of a card.

The description of this embodiment referred only to printing of a copy on an output sheet 52, but the use of this invention may also include reproduction of image data. For instance, a server or a personal computer can be connected to the system network shown in FIG. 7 to transmit and receive data. In this case, copyrighted works can be protected and alterations restored appropriately by appending copyright information to the image data.

What is claimed is:

1. An image formation apparatus for producing copies of documents containing images, comprising:

an image reading unit for reading the image of a document;

an image information acquiring unit for acquiring image information from the document, the image information including image data; and a permission/refusal determining unit for comparing the image read by said image reading unit and the image data acquired by said image information acquiring unit, and permitting reproduction of the image of the document as it is when it is determined that the read image read by said image reading unit and the image data acquired by said image information acquiring unit are identical based on a previously set judgment level and refusing when it is determined the read image and the acquired image data are nonidentical, wherein a copy is produced from the reproduced image of the document if permitted by said permission/refusal determining unit.

2. The image formation apparatus according to claim 1, further comprising:

an image formation unit for forming an image on a sheet-shaped medium; and a writing unit for writing into a memory embedded in the medium the image information acquired by said image information acquiring unit.

3. The image formation apparatus according to claim 2, further comprising:

a forbidding unit for forbidding image formation when no memory is embedded in the medium on which an image is to be formed.

4. The image formation apparatus according to claim 1, wherein:

said image information acquiring unit acquires image information containing copyright information.

5. The image formation apparatus according to claim 1, further comprising:

an image information receiver unit for acquiring image information regarding documents from an external server via a network.

6. An image formation apparatus for producing copies of documents containing images, comprising:

an image reading unit for reading the image of a document;

an image information acquiring unit for acquiring image information from the document, the image information including image data;

a permission/refusal determining unit for comparing the image read by said image reading unit and the image data acquired by said image information acquiring unit, and determining whether or not reproduction of the image of the document as it is can be permitted according to the extent of difference between the read image and the acquired image data;

wherein a copy is produced from the reproduced image of the document if permitted by said permission/refusal determining unit;

a restoration permissible/impermissible determining unit for determining whether or not restoration of the image read by said image reading unit according to the image information acquired by said image information acquiring unit is permissible when said permission/refusal determining unit determines refusal, and a restoring unit for restoring the image read by said image reading unit according to the image information acquired by said image information acquiring unit, wherein a copy is produced from the image restored by said restoring unit if restoration is determined by said restoration permissible/impermissible determining unit to be eligible for restoration.

7. The image formation apparatus according to claim 6, wherein:

said restoration permissible/impermissible determining unit determines whether or not restoration is permissible according to the extent of difference between the read image and the acquired image information.

8. The image formation apparatus according to claim 6, wherein:

said restoration permissible/impermissible determining unit determines whether or not restoration is permissible according to whether or not restoration forbid information is contained in the image information acquired by said image information acquiring unit.

9. The image formation apparatus according to claim 6, further comprising:

a selector unit for enabling the user to opt for either execution or non-execution of restoration of the image with said restoring unit when said restoration permissible/impermissible determining unit has determined restoration to be permissible; and a fee charging unit for charging an additional fee when restoration is to be executed.

10. An image formation apparatus for producing copies of documents containing images, comprising:

an image reading unit for reading the image of a document;

an image information acquiring unit for acquiring image information from the document, the image information including image data; and a permission/refusal determining unit for comparing the image read by said image reading unit and the image data acquired by said image information acquiring unit, and determining whether or not reproduction of the image of the document as it is can be permitted according to the extent of difference between the read image and the acquired image data;

wherein a copy is produced from the reproduced image of the document if permitted by said permission/refusal determining unit;

said permission/refusal determining unit makes a decision for each image area where the document has a plurality of image areas and there is image information regarding each image area.

11. An image formation method for producing copies of documents containing images, comprising steps of:

reading the image of a document;

acquiring image information from the document, the image information including image data;

assessing the extent of difference between the image read from the document and the acquired image data by comparing them;

permitting reproduction of the image of the document as it is when it is determined that the read image read by said image reading unit and the image data acquired by said image information acquiring unit are identical based on a previously set judgment level and refusing when it is determined the read image and the acquired image data are nonidentical; and producing a copy of the document from the reproduced image of thereof if permitted.

12. The image formation method according to claim 11, wherein production of a copy includes the steps of:

forming an image on a sheet-shaped medium; and writing the acquired image information into a memory embedded in the medium.

13. The image formation method according to claim 12, further having the steps of:

judging whether or not a memory is embedded in the medium on which an image is to be formed; and forbidding image formation when no memory is embedded.

14. The image formation method according to claim 11, wherein:

copyright information is also acquired when image information on the document is acquired.

15. The image formation method according to claim 11, further having the step of:

acquiring image information regarding documents from an external server via a network.

16. An image formation method for producing copies of documents containing images, comprising steps of:

reading the image of a document;

acquiring image information from the document, the image information including image data;

assessing the extent of difference between the image read from the document and the acquired image data by comparing them;

determining whether or not reproduction of the image of the document as it is can be permitted according to the extent of difference;

producing a copy of the document from the reproduced image of thereof if permitted;

determining whether or not restoration of the image read from the document is permissible according to the acquired image information when the reproduction thereof as it is has been determined to be impermissible;

restoring the read image according to the acquired image information if such restoration is determined permissible; and producing a copy from the restored image.

17. The image formation method according to claim 16, wherein:

whether or not restoration is permissible is determined according to the extent of difference between the read image and the acquired image information.

18. The image formation method according to claim 16, wherein:

whether or not restoration is permissible is determined according to whether or not the acquired image information contains restoration forbid information.

19. The image formation method according to claim 16, further having the steps of:

enabling the user to opt for either execution or non-execution of restoration of the image when restoration has been determined permissible; and charging an additional fee when restoration is to be executed.

20. An image formation method for producing copies of documents containing images, comprising steps of:

reading the image of a document;

acquiring image information from the document, the image information including image data;

assessing the extent of difference between the image read from the document and the acquired image data by comparing them;

determining whether or not reproduction of the image of the document as it is can be permitted according to the extent of difference;

producing a copy of the document from the reproduced image of thereof if permitted:

wherein when the document has a plurality of image areas and there is image information regarding each image area, a decision as to whether or not reproduction of the image of the document as it is can be permitted is made for each image area.

* * * * *